United States Patent [19]

Tsukamoto et al.

[11] 3,954,001

[45] May 4, 1976

[54] DIES FOR CROSS ROLLING MACHINES

[75] Inventors: Hidehiko Tsukamoto; Nobutaka Maeda, both of Hiroshima, Japan

[73] Assignee: Mitsubishi Jukogyo Kabushiki Kaisha, Tokyo, Japan

[22] Filed: Oct. 2, 1974

[21] Appl. No.: 511,262

[30] Foreign Application Priority Data

Oct. 8, 1973 Japan ..... 48-112262

[52] U.S. Cl. ..... 72/469

[51] Int. Cl.[2] ..... B21H 1/18

[58] Field of Search ..... 72/88, 90, 469, 196, 72/191, 102, 105, 109, 111, 108

[56] References Cited

UNITED STATES PATENTS

| | | | |
|---|---|---|---|
| 319,754 | 6/1885 | Simonds | 72/469 |
| 319,755 | 6/1885 | Simonds | 72/88 |
| 319,756 | 6/1885 | Simonds | 72/469 |
| 3,827,269 | 8/1974 | Hoagland et al. | 72/191 X |

*Primary Examiner*—Milton S. Mehr

*Attorney, Agent, or Firm*—Toren, McGeady and Stanger

[57] ABSTRACT

Dies for cross rolling machines for manufacturing a graduated shaft from a round bar, characterized therein that levels of dies in contact with a rolled material is formed increasingly higher from a developing point of shaping for the dies in the forward direction of said dies to a finishing point of shaping for the dies so as to elongate a minimum diameter portion or a portion of axis having large surface reduction by top portions of the dies during advance in the rolling operation of the dies.

1 Claim, 16 Drawing Figures

FIG.1(I)
PRIOR ART
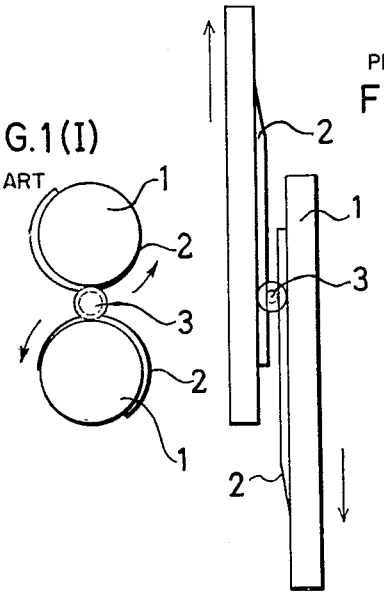
FIG.1(II)
PRIOR ART
PRIOR ART
FIG.2(IV)
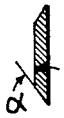
FIG.2(I)
PRIOR ART
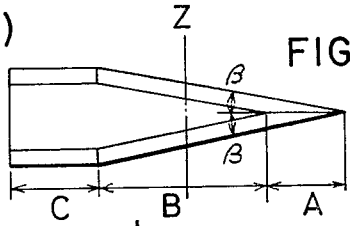
FIG. 2(II)
PRIOR ART
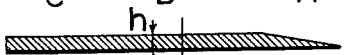
FIG. 2(III)
PRIOR ART
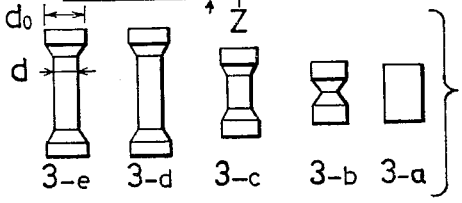
FIG. 3(I) PRIOR ART
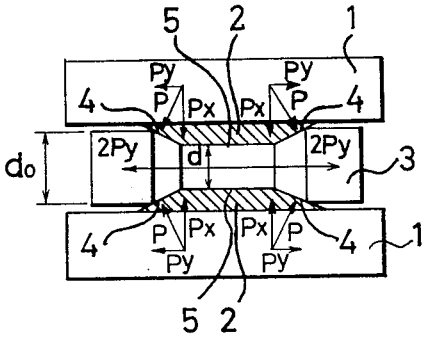
FIG. 3(II)
PRIOR ART
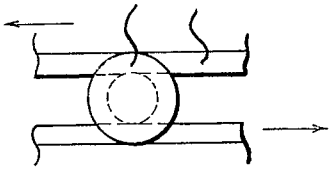

DIES FOR CROSS ROLLING MACHINES

This invention relates to improvements in dies for cross rolling machines used for the manufacture from a round bar of a shaft having a reduced central section.

Generally, the dies used for manufacturing such a shaft have been incorporated in cross rolling machines and the method whereby the dies were utilized in the cross rolling machines included the use of rolling dies and flat dies as best seen in FIG. 1 and FIG. 2, respectively, in the attached drawings. Thus, as seen in FIG. 1 (I), a material round bar 3 may be delivered between rolls 1 and the rolls 1 be rotated in a same direction, whereby the material round bar 3 is compressed between dies 2 mounted on the rolls 1 so as to provide a desired form of a graduated shaft. Otherwise, a material round bar may be compressed between two planes respectively on two flat dies and operated on the same principle as applied for operation of the rolling dies.

The method of forming a graduated shaft from a material bar provides such that the bar, as shown in FIG. 2, may be rolled in the middle of its body with its diameter do reduced up to d during progress of rotation of the dies.

In FIG. 2 (I) is provided an exploded plan view of rolling dies. A transverse sectional view of the rolling dies is shown in FIG. 2 (IV) in their forward direction. Also, a vertical cross section of the rolling dies is shown in FIG. 2 (II). Further, a material bar in the rolling operation at each part of the die is shown in FIG. 2, 3-*a* to 3-*e*. Through these figures, 3-*c* indicates a form of a material bar which is positioned along a phantom line Z traversing it during its rolling operation. It is understood that $\alpha$ and $\beta$ respectively designate a wedge angle and an advance angle of the dies and $h$ a height of the dies. The material bar is then shaped into a final product as the dies may advance in rolling as shown in FIG. 2, 3-*a* to 3-*e*.

A die may essentially consist of a threading section A, a developing section B, and a finishing section C, these sections respectively serving to cut in a given material up to a diameter d in the material, develop a cutout in the material of a fixed diameter or along the circumference of the material, and lastly processing the material into a final product. FIG. 2, 3-*b* shows a form of a finished product when the threading operation of the die is completed and at the same time the developing operation is started; 3-*c* shows a form of the rolled material during the developing operation; 3-*d* shows the rolled material when the developing operation finishes and the finishing operation starts; and 3-*c* shows a completed rolled bar. Those forms of the dies in the parts corresponding respectively to points 3-*d* and 3-*e* are identical to each other and height h of the dies in the parts corresponding respectively to points, 3-*b*, 3-*c*, 3-*d*, and 3-*e* are definite through all operations of the rolling.

As is well known, if the ratio of a final diameter d of a product to a diameter of a material or to the maximum diameter of a product, as expressed by $do/d$, is too small or the ratio of surface reduction in a material is very large, there is caused a constriction in the material during rolling operation, or tearing in the product. Thus, rolling of a graduated shaft causing such large surface reduction has been difficult by use of any conventional dies.

The surface reduction as above described which may occur in the product by conventional cross rolling dies involved limitation, the value of such limitation of the surface reduction being variable depending on the described wedge angle $\alpha$ and the advance angle $\beta$ but an approximate value of 75% has been accepted as normal. For this reason, the forming of the graduated shaft by conventional cross rolling method has been limited in the ratio of surface reduction and a considerable number of dies could not be used even though they were expected to lower the cost of manufacture by use of the cross rolling method.

Therefore, an object of the invention is to provide the dies which can easily remove such limitation of surface reduction in order to secure a large range of use in the cross rolling machine. Thus, the object of the invention is to provide the dies which can be manufactured in the way that the surface reduction may be retained fully in ratio.

Briefly, the present invention may be described as a particular structural configuration for dies utilized in cross rolling machines for manufacturing from round bar stock an axially symmetrical shaft having a reduced central portion. The dies may comprise a flat planar base surface and shaping surfaces on the opposite side of said base surface. The shaping surfaces which, in conventional dies, are normally parallel to the base surface, are formed with a progressively sloping configuration which increases from the commencing points of the portion of the die whereat lateral extension of the rolled bar stock is performed to the commencing points of a finish forming portion of the dies so that the manufacture of the shafts with a small diameter portion may be achieved without any defects by additional reducing and spreading of the shaft material by shaping surfaces of the dies during the lateral extension of the shaft material.

In the drawings:

FIG. 1 (I) is an end view of a conventional rotating die forming arrangement;

FIG. 1 (II) is an end view of a conventional linear die forming arrangement;

FIG. 2 (I) is a plan view of a conventional die;

FIG. 2 (II) is a sectional view of a conventional die;

FIG. 2 (III) shows bar stock formed utilizing a conventional die illustrated in various stages of its development;

FIG. 2 (IV) is a cross sectional view of the conventional die shown in FIG. 2 (I);

Figure 4:
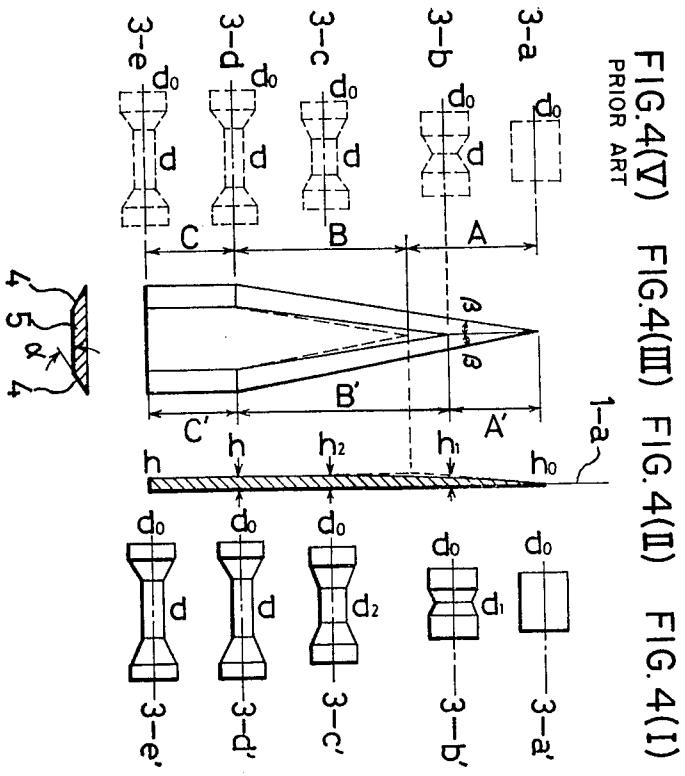
Figure 5I:
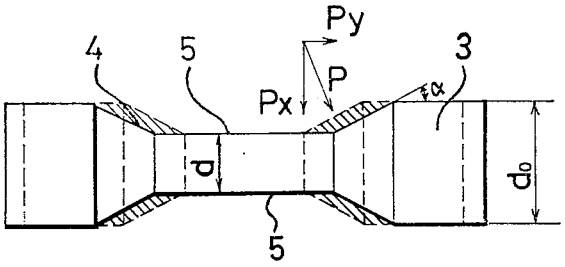
FIG 5(I) PRIOR ART
Figure 5:
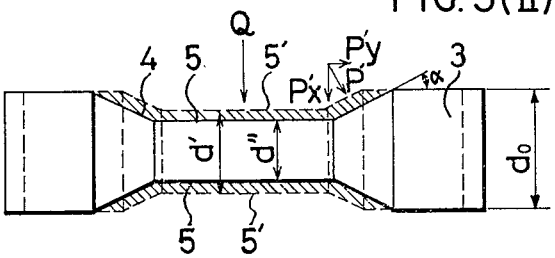
Figure 6:
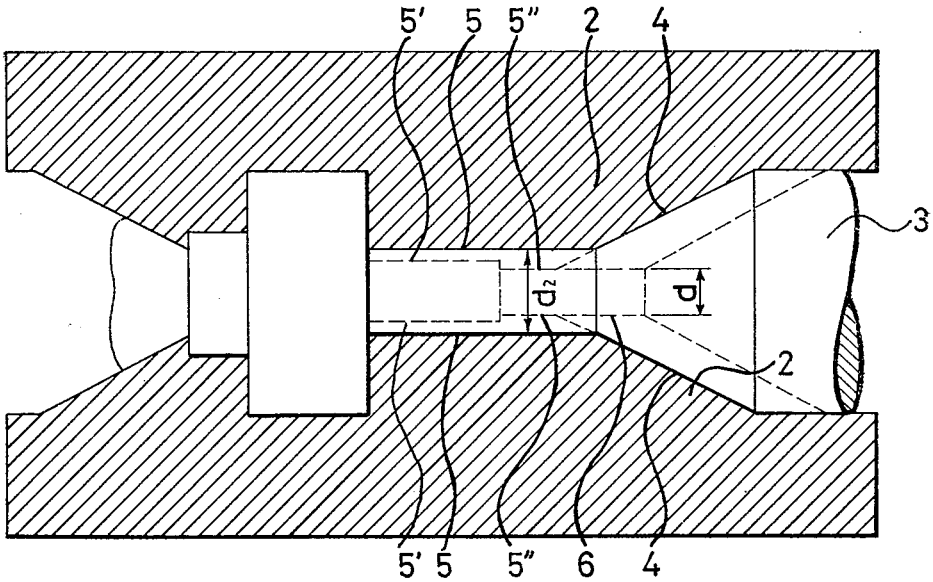

FIG. 3, (I) is a view partially in section showing bar stock being formed with conventional dies;

FIG. 3 (II) is an end view of the arrangement of FIG. 3 (I);

FIG. 4 (I) shows bar stock formed utilizing the dies of the present invention and illustrated in various stages of development;

FIG. 4 (II) is a side sectional view of a die in accordance with the present invention;

FIG. 4 (III) is a plan view of a die in accordance with the present invention;

FIG. 4 (IV) is a side sectional view of the die of the present invention;

FIG. 4 (V) shows in dotted form bar stock formed utilizing a conventional die and illustrated in various stages of development for the purposes of comparison with the bar stock shown in FIG. 4 (I):

FIG. 5 (I) shows bar stock formed with conventional dies and shown during the process of its development;

FIG. 5 (II) shows bar stock formed with dies of the present invention and illustrated during the process of its development; and FIG. 6 is a partial sectional view showing an arrangement wherein there is applied dies incorporating the principles of the present invention.

A relationship between a rolled material and a dies in a preferred position in the developing section B of FIG. 2 according to the present invention is illustrated in FIGS. 3 (I) and 3 (II). In the figure, numerals 2 and 3 respectively designate cross sections in the axial direction of the die and the rolled bar material. In the prior art cross rolling dies, the constriction or deficiency in the die body has often occurred owing to the axial component PY of the rolling force P which may be retained in the rolled material, the force acting upon the material 3 during its rolling against the compressed surface 4 of the rolled material as may be apparent from FIG. 3 (I). In this instance, the rolled material 3 is subjected to an axial tension force 2 PY applied from the compressed surfaces 4 of the upper and lower dies in their cylindrical portions having the diameter $d$ and being held between non-compressed surfaces 5 on the top of the dies, as seen in the drawing. When the diameter of the rolled material or the maximum diameter $d_o$ of the material are unvariable, and also the wedge angle $\alpha$ and the advance angle $\beta$ are constantly provided, the length of the compressed surface 4 along the direction of the wedge angle $\alpha$ must be larger if the size of the minimum diameter d of the material is small and accordingly the rolling force P will be increased. This results in the increase of the axial tension force 2 PY. If the minimum diameter $d$ is further reduced, the axial cross section $\pi d^2/4$ in this part will become small. Therefore, the tension stress $2\ PY/\pi d^2/4$ in this part may be increased. If the value exceeds a limit, there will be produced in the material a constriction similar to that which is produced during a normal experiment testing for maximum tensile strength.

As described above, it may be understood that the constriction in the rolling operation may be derived from the tension stress produced in the minimum diameter axis by the axial component PY of the rolling force P in the bar material. These drawbacks of the bar material may be avoided adequately by the methods mentioned in the following.

i. The tension force 2 PY may be reduced to minimum in the axial direction of the bar material.

ii. The minimum diameter part in the rolled material may be developed larger during its rolling operation.

Therefore, it is an object of the invention to provide the dies which can fulfill the requirements to solve the above two problems.

These and other objects and advantages of the invention will become more apparent from the following description made by way of example with reference to the accompanying drawings, in which FIG. 1 (I), (II) to FIG. 3 (I), (II) are schematic diagrams illustrating the die rolling and forming by use of the conventional cross rolling machine;

FIGS. 4–6 are schematic illustrative views of an embodiment of the invention; FIG. 4 (I) shows a process of forming a rolled material by use of the die of the invention, FIG. 4, (II) is a cross sectional view of a die; FIG. 4, (III) is a plan view of a die; FIG. 4, (IV) is a transverse sectional view of a final form of a die; and FIG. 4, (V) is a view illustrating a process of forming a rolled material by the conventional die, showing a comparison with FIG. 4, (I);

FIG. 5, (I) is a view as seen from an axial vertical direction of a rolled material as modified in the developing section of the conventional die and FIG. 5, (II) is a view of the die according to the present invention modified as seen from the same direction.

FIG. 6 is a schematic illustrative view of an actual product obtained by rolling of the die of the invention.

The die according to the present invention is now described with reference to FIGS. 4 to 6.

FIG. 4 shows an application of the die of the invention in a cross rolling machine shown in FIG. 2, and FIG. 4 (I) shows a process of forming a rolled material by use of the die of the invention. In the drawing, $d_o$ is the diameter of the material and $d_1$, $d_2$, $d$ are respectively variations in the diameters of a rolled material in their minimum diameter portions. FIG. 4, (II) is a vertical sectional view of dies, in which broken lines represent cross sections of the conventional dies. FIG. 4, (III) is a plan view of the dies, in which broken lines represent the conventional dies. In the drawing, A, B, and C respectively show the threading, developing and finishing sections of the conventional dies and A′, B′, and C′ similarly show the threading, developing and finishing sections of the dies of the invention. In the similar way, FIG. 4 (IV) below FIG. 4 (III) shows a transverse section of a final form of the dies according to the invention.

FIG. 4 (V) represented in broken lines on the left shows a process of formation of a rolled material in the conventional dies as seen from the bottom part of FIG. 2. In the drawing, $d_o$ shows the diameter of the material; $d$ the diameter in the minimum diameter portion of the product obtained in each die forming process. In these examples, each diameter is fixedly provided, that is, the top portion of the shaping surface 4 is developed in the axial direction along a contour line of the product except in the threading section.

In the developing section B of the conventional die, the level in height from the normal shaping surface of the die, 1-$a$, has a fixed value, as shown in FIG. 4, (II), so that the top portion of the shaping surface 4 shown in FIG. 4 will lie in the line of the final outer contour of the rolled material. However, in the dies of the invention, the level in height of the developing section has no definite value relative to the forwarding direction of the dies. Those levels of the dies have respectively the values: $h1$ in the starting part of the developing section, $h2$ in the intermediate position of the developing section, and $h2$ in a position between $h1$ and $h$ which is the final height (same as the height in the starting part of the finishing section), thus meeting the requirement of $h1 < h2 < h$. Particularly, in the developing section B′, the dies may take the heights $h1$, $h2$, and $h$ in the order that the heights become increasingly and gradually larger.

A comparison of the working principle of the dies of this invention with that of the known dies is given in FIG. 5, of which FIG. 5 (I) is a view as seen from an axial and perpendicular direction of the dies as modified for the rolled material in the developing section of the conventional dies, and FIG. 5 (II) is a view as seen from the same direction in a modification of the present dies. In FIG. 5, 3 denotes the rolled material; 4 the shaping surfaces, and 5 the top surfaces of the dies, respectively. Broken lines show a shape of the rolled material during operation in the preceding rolling stage as shown by solid lines. Thus, the rolling dies will form the material into a product in an amount of projection as indicated by hatching. In the conventional dies, the rolled material is shaped during compression and elongated solely by use of the shaping surfaces of the dies as shown in FIG. 5 (I). This produces a tension force proportionate to the amount of $PY/\pi d^2/4$ due to the axial component of the rolling force P of the rolled material in their shaping surfaces as shown.

In the dies of the present invention, it is provided that such top portions of the dies shown in FIG. 4 (II) are made increasingly higher, the portion of the diameter $d'$ defined by broken lines in FIG. 5 (II) are axially elongated by the top portions 5, 5 of the dies to a diameter $d''$ of the material as defined by 5, 5 in the figure. A substantial amount of compression in the shaping section 4 of the dies may be reduced to an amount corresponding to an amount in the cylindrical portion of the material ranging between 5' and 5', since the oblique shaped surfaces of the material are reduced on both sides to the same amount of compression. The rolling force P' certainly will become smaller than the rolling force in the conventional dies, so that the axial component PY of the rolling force P' may be reduced smaller than the axial component PY of the rolling force P'.

The diameter $d''$ of the axis of the rolled material on which tension force acts may be larger than the diameter of the finished product, the amount of the tension force applied in such portion being proportionate to $P'Y/(\pi/4)d''^2$. This tension force may be much smaller than the axial tension force $PY/(\pi/4)d^2$ of the rolled material in the conventional dies.

The dies according to the invention thus enables a positive elongation in the portion corresponding to the minimum diameter of the product which has a large surface reduction which has been considered as a drawback in the rolling operation for the conventional dies. A desired rolling operation is thus possible by the present invention without reducing the axial tension force in the minimum diameter portion or effecting constrictions in the rolled material. This improvement may be achieved only by slight modification of the conventional dies in comply with all requirements as above described.

In FIG. 6, application in practice of the dies incorporating the present invention is shown by way of example. In the figure, 2, 2 denote rolling dies; 3 a material in the developing section during rolling operation; and 4 compressing and shaping surfaces; 5 a top portion of a die; and 5', 5'' top portions of the conventional dies, the numeral 6 denoting a shape of a finished product defined by broken lines. In the example, it will be noted that in the conventional dies the outer contour of the finished product and the die tops 5', 5'' are in contact to each other along a length of the developing section, whereas in the present invention the shaping surfaces 5 of the dies become increasingly higher from the base surfaces 7 of the dies during the reducing and spreading operation, i.e., during the lateral extension of the metal, and in the way of the lateral extension the height of shaping surfaces 5 from the base surface 7 of the dies is lower than the surfaces 5', 5'' of the conventional dies as indicated in FIG. 6. This characteristic feature of the invention lead to the manufacture of the product having the surface reduction that cannot be attained by the conventional dies.

The dies of the cross rolling machine according to the present invention thus provides for that the levels of the dies in the top portions of the dies in contact with a rolled material is formed increasingly higher from a developing point of shaping for the dies in the forward direction of the dies to a finishing point of shaping for the dies so as to elongate a minimum diameter portion or a portion of axis having large surface reduction by top portions of the dies during advance in the rolling operation of the dies.

Therefore, the drawbacks of the conventional dies can be removed by the invention. An effective application of the cross rolling machine to the rolling and shaping of the graduated shaft can be increased with a practical result desirably obtained.

What is claimed is:

1. Dies for cross rolling machines for manufacturing from round bar stock an axially symmetrical shaft having a reduced central section comprising a shaping side on one side of said dies, said shaping side being configured for rolling engagement with said bar stock to form said axially symmetrical shaft, said dies being movable in a given linear direction to effect said rolling engagement in the formation of said shaft, said shaping side having formed thereon shaping surfaces defining said shaping side as including a threading section, a finishing section and a developing section located intermediate said threading and finishing sections taken relative to said linear direction of movement of said dies, said threading section comprising shaping surfaces for commencing engagement of said bar stock with said dies to initiate formation of said shaft, said developing section being configured to include a reduction shaping surface for effecting reduction of the diameter of said bar stock and lateral extension shaping surfaces for effecting lateral extension of the material of said bar stock, said developing section being formed with said reduction shaping surface and said lateral extension shaping surfaces arranged to effect said reduction and lateral extension simultaneously while said bar stock is in rolling contact with said developing section, said reduction shaping surface being formed throughout its length with a continuous taper taken relative to said linear direction of movement of said dies to enable said developing section to gradually reduce the central diameter of said bar stock while also effecting lateral extension thereof.

* * * * *